US006098245A

United States Patent [19]

Satterfield et al.

[11] Patent Number: 6,098,245

[45] Date of Patent: Aug. 8, 2000

[54] VACUUM CLEANER MOTOR ASSEMBLY

[75] Inventors: R. Gerald Satterfield, Pickens; W. Keith Glenn, Anderson; David G. Peot, Easley, all of S.C.

[73] Assignee: Ryobi North America, Inc., Anderson, S.C.

[21] Appl. No.: 09/164,175

[22] Filed: Sep. 30, 1998

[51] Int. Cl.[7] ..... A47L 9/22

[52] U.S. Cl. ..... 15/412; 15/351; 29/434; 417/423.2; 417/423.14

[58] Field of Search ..... 15/350, 351, 412; 417/423.2, 423.12, 423.14; 29/428, 434

[56] References Cited

U.S. PATENT DOCUMENTS

| | | | |
|---|---|---|---|
| 2,613,242 | 10/1952 | Shumaker et al. | 15/412 X |
| 2,649,609 | 8/1953 | Turner | 15/412 X |
| 3,854,164 | 12/1974 | Schmitz . | |
| 4,623,811 | 11/1986 | Nystuen et al. | 15/412 X |
| 4,656,688 | 4/1987 | Jacob et al. . | |
| 4,686,736 | 8/1987 | Petralia et al. . | |
| 4,811,450 | 3/1989 | Steadings . | |
| 4,996,737 | 3/1991 | Madru, Sr. . | |
| 5,056,175 | 10/1991 | Stein et al. . | |
| 5,093,956 | 3/1992 | Saunders et al. . | |
| 5,129,128 | 7/1992 | Bowerman et al. | 15/412 X |
| 5,134,749 | 8/1992 | Sakurai et al. . | |
| 5,222,276 | 6/1993 | Glenn, III . | |
| 5,224,238 | 7/1993 | Bartlett | 15/412 X |
| 5,279,018 | 1/1994 | Glenn, III . | |
| 5,388,302 | 2/1995 | Sundaram et al. | 15/412 X |
| 5,551,122 | 9/1996 | Burkhardt et al. | 15/412 X |
| 5,584,095 | 12/1996 | Redding et al. . | |

*Primary Examiner*—Chris K. Moore
*Attorney, Agent, or Firm*—Brooks & Kushman P.C.

[57] ABSTRACT

A motor assembly for use in a vacuum cleaner utilizes a clam-shell type housing having a plurality of shell components that cooperate with each other to define a fan cavity and a motor cavity adjacent to the fan cavity. The housing has a fan cavity inlet and a fan cavity outlet. A field is received in the motor cavity. An armature assembly includes an armature shaft extending through the field and extending into the fan cavity. A pair of brushes are mounted to the housing in the motor cavity, and contact a commutator. A fan blade is disposed in the fan cavity and secured to the armature shaft for rotation together therewith. The fan blade rotates with the armature shaft during motor operation to cause airflow from the fan cavity inlet to the fan cavity outlet.

16 Claims, 3 Drawing Sheets

VACUUM CLEANER MOTOR ASSEMBLY

TECHNICAL FIELD

The present invention relates to motor assemblies for use in vacuum cleaners.

BACKGROUND ART

A typical upright vacuum cleaner has a vacuum cleaner chassis with a head portion for moving along a surface being vacuumed. A body portion of the vacuum cleaner chassis is pivotally attached to the head portion. Pivoting the chassis body portion relative to the chassis head portion allows a user to easily and quickly vacuum a large area.

A motor assembly mounted within the vacuum cleaner chassis drives a fan to provide the suction needed to pick up dirt and debris. In one existing vacuum cleaner design, the motor assembly components are mounted directly in the vacuum cleaner chassis. In another existing vacuum cleaner design, a stack-up type motor assembly is mounted in the vacuum cleaner chassis. In a stack-up type motor assembly, motor assembly components are stacked up on the armature assembly, and vertically placed into a motor housing. The stacked-up motor assembly is then placed into the vacuum cleaner chassis.

While vacuum cleaner designs with direct chassis mounting of the motor assembly or designs with stack-up motor assemblies are suitable for a number of applications which have been commercially successful, the motor assembly components are costly.

SUMMARY OF THE INVENTION

It is, therefore, an object of the present invention to provide a clam-shell type motor assembly for use in a vacuum cleaner that is relatively inexpensive in comparison to stack-up designs and direct chassis mount designs.

In carrying out the above objects and other objects and features of the present invention, a motor assembly for use in a vacuum cleaner is provided. The motor assembly comprises a clam-shell type housing having a plurality of shell components that cooperate with each other to define a fan cavity and a motor cavity adjacent to the fan cavity. The housing has an inlet in communication with the fan cavity, and an outlet in communication with the fan cavity. A field is received in the motor cavity. An armature assembly includes an armature shaft extending through the field and extending into the fan cavity. A winding is formed on the armature shaft. A commutator affixed generally adjacent to the armature shaft rotates together with the armature shaft. A pair of brushes are mounted to the housing in the motor cavity and contact the commutator. A fan blade is disposed in the fan cavity, and is secured to the armature shaft for rotation together therewith. The fan blade rotates with the armature shaft during motor operation to cause airflow from the fan cavity inlet to the fan cavity outlet.

In a preferred embodiment, the housing is formed by first and second mating shell halves. The first and second shell halves cooperate to hold the field, armature assembly, and brushes in position within the housing. Further, in a preferred embodiment, the motor assembly further comprises a pair of leads for connecting the motor to a power source. A power connector having a pair of slots for receiving the pair of leads therein is formed integrally with the housing. Still further, the housing is preferably made of plastic.

Further, in carrying out the present invention, a vacuum cleaner is provided. The vacuum cleaner comprises a vacuum cleaner chassis, a clam-shell type housing mounted to the chassis, a field, an armature, brushes, and a fan blade. Preferably, the motor assembly is mounted to a body portion of the vacuum cleaner chassis. The body portion is pivotally attached to a head portion of the vacuum cleaner chassis to allow the body portion to pivot together relative to the vacuum cleaner chassis head portion.

Still further, in carrying out the present invention, a method of assembling a motor assembly for a vacuum cleaner is provided. The method comprises, forming a clam-shell type housing, positioning a field, positioning an armature assembly, mounting a pair of brushes, and securing a fan blade to the armature shaft.

The advantages associated with embodiments of the present invention are numerous. For example, the clam-shell type housing reduces the overall cost of the motor assembly. In particular, the use of a power connector formed integrally with the housing greatly reduces the per unit cost associated with manufacturing vacuum cleaner motor assemblies.

The above objects and other objects, features, and advantages of the present invention are readily apparent from the following detailed description of the best mode for carrying out the invention when taken in connection with the accompanying drawings.

BEST MODE FOR CARRYING OUT THE INVENTION

Figure 1:
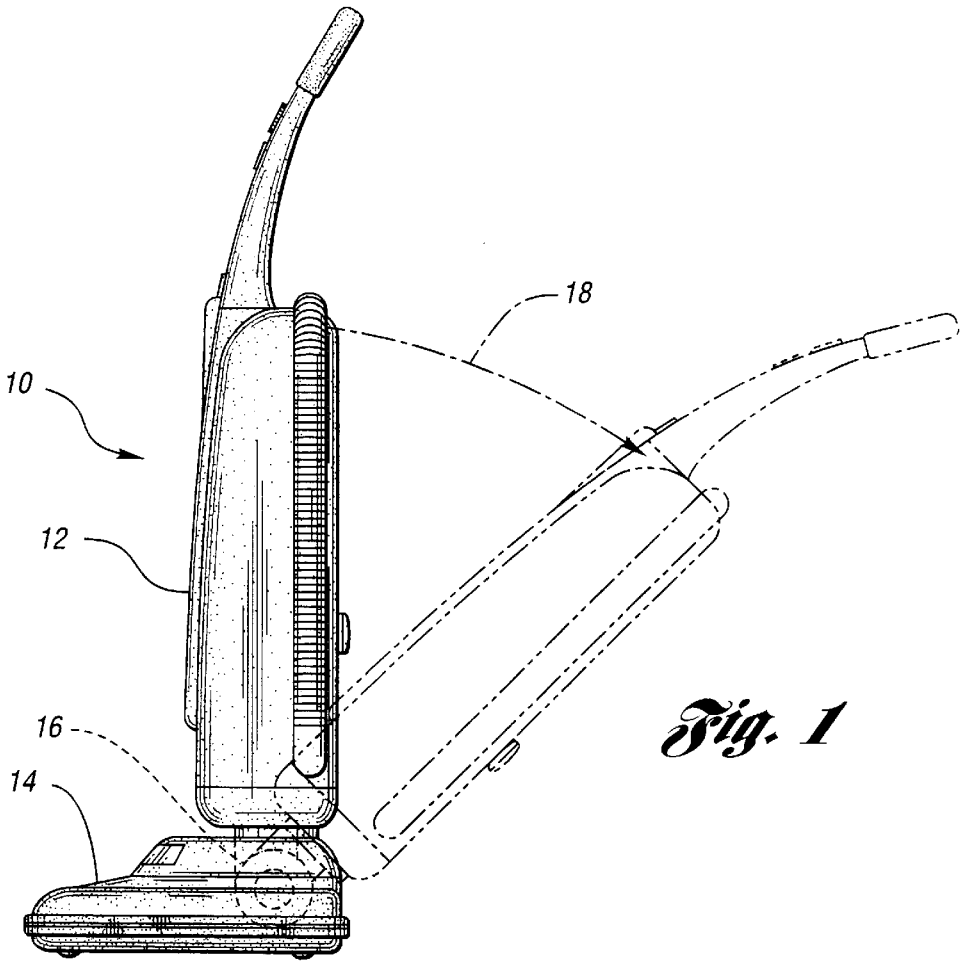
FIG. 1 is a vacuum cleaner of the present invention having a clam-shell type motor assembly.

With reference to FIG. 1, a vacuum cleaner of the present invention is generally indicated at 10. Vacuum cleaner 10 has a vacuum cleaner chassis composed of a body portion 12 and a head portion 14. A motor assembly 16 is mounted to body portion 12 to pivot with body portion 12 relative to head portion 14. A user may pivot body portion 12 and motor assembly 16 relative to head portion 14 when using vacuum cleaner 10, in the direction of arrow 18.

Figure 2:
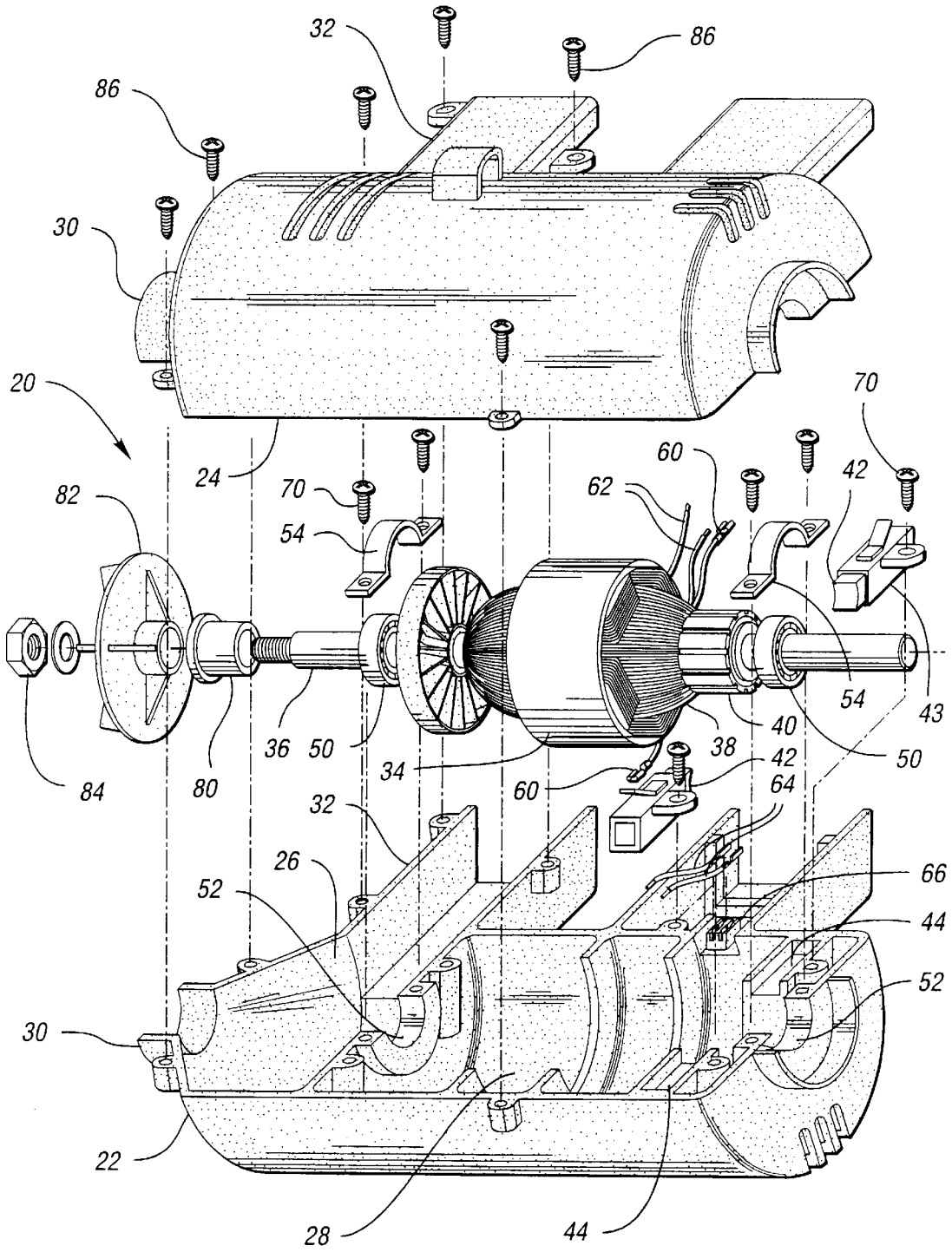
FIG. 2 is an exploded perspective view of a clam-shell type motor assembly of the present invention.

With reference to FIG. 2, a motor assembly 20 includes first and second mating shell halves 22 and 24, respectively. The first and second shell halves 22 and 24, respectively, form a clam-shell type housing, and cooperate with each other to define a fan cavity 26 and a motor cavity 28 adjacent to the fan cavity 26. The housing has an inlet 30 in communication with the fan cavity 26, and an outlet 32 in communication with the fan cavity 26. Of course, it is to be appreciated that the use of first and second shell halves 22 and 24, respectively, is a preferred way to form the motor housing, and that the motor housing may be formed with other pluralities of shell components that cooperate in a similar fashion. Further, although first and second shell halves 22 and 24, respectively, are shown as substantially symmetrical, it is to be appreciated that the halves need not be symmetrical and that the part lines on the shell halves need not be planer.

A field 34 is received in motor cavity 28. An armature assembly includes an armature shaft 36 extending through field 34 and into fan cavity 26. A winding 38 is formed about armature shaft 36. A commutator 40 is affixed generally adjacent to armature shaft 36 for rotation together with armature shaft 36. A pair of brushes 42 are received in a corresponding pair of brush holders 43 and are received in motor cavity 28 at housing mounting portions 44.

Armature shaft 36 is supported by a pair of bearings 50. A pair of bearing seats 52 are integral with the housing and support the pair of bearings 50. Clips 54, or other suitable means, further secure the bearings 50 in their seats 52.

First and second pairs of leads 60 and 62, respectively, are connected to the windings of field 34. Leads 60 connect to brushes 42, while leads 62 connect to a power source. Of course, it is to be appreciated that the motor assembly need not be wired in any particular manner, and that there are various different ways to wire a motor, and further that the field may be a wound field or a field generated from permanent magnets.

Figure 3:
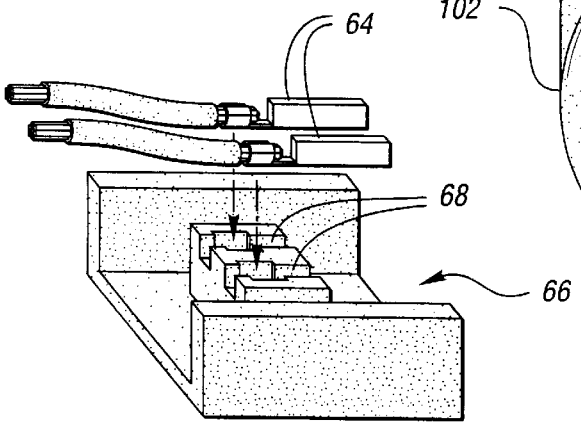
FIG. 3 is a perspective view of a power connector that may be formed integrally with the motor assembly housing, in accordance with the present invention.

Leads 64 are wired to the rest of the motor wiring, and are for connecting the motor to the power source. Leads 64 may simply protrude from a slot formed in the motor housing; but, in a preferred embodiment, a power connector is formed integrally with the housing which is made of plastic. The power connector 66 is best shown in FIG. 3, and includes a pair of slots 68 for receiving the pair of leads 64. Preferably, leads 64 snap into slots 68. The integrally formed power connector eliminates the need for an expensive additional component for the motor assembly.

With continuing reference to FIG. 2, armature shaft 36, bearings 50, and brushes 42 are held in place by a plurality of screws 70. Armature shaft 36 has an end fitting 80 for attaching a fan blade 82. Fan blade 82 is secured to armature shaft 36 by nut 84. When assembled, fan blade 82 resides in fan cavity 26 and rotates with armature shaft 36 during motor operation. Rotating fan blade 82 causes airflow from fan cavity inlet 30 to fan cavity outlet 32. First and second shell halves 22 and 24, respectively, are secured together by a plurality of screws 86. Advantageously, the internal motor components including armature shaft 36, bearings 50, brushes 42, and any shell half connector pins are directly mounted to the first and second shell halves 22 and 24, respectively.

Figure 4:
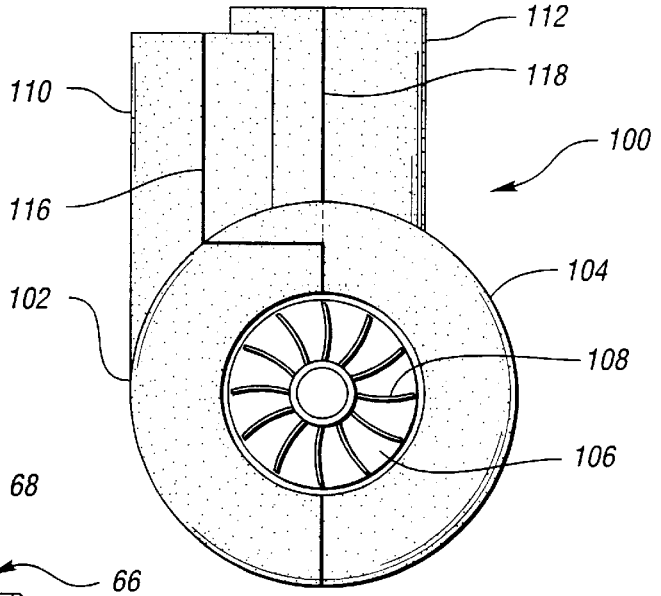
FIG. 4 is a side view of an alternative embodiment for a clam-shell type motor assembly of the present invention.

With reference to FIG. 4, an alternative embodiment for a clam-shell type motor assembly housing is generally indicated at 100. Housing 100 includes first and second shell halves 102 and 104, respectively. First and second shell halves 102 and 104, respectively, cooperate to define a fan cavity and a motor cavity. The fan cavity has an inlet 106, and encloses a rotary fan blade 108. A fan cavity outlet 110 receives airflow from inlet 106 during motor operation. Similar to the housing shown in FIG. 2, housing 100 includes fan cavity outlet 110, in addition to housing portion 112 which is generally parallel to outlet 110.

First and second shell halves 102 and 104, respectively, have non-planar part lines. At the fan cavity end of housing 100, a non-planar part line 116 allows fan cavity outlet 110 to be located substantially on one side of housing 100. At the motor cavity end of housing 100, part line 118 is generally planar.

Figure 5:
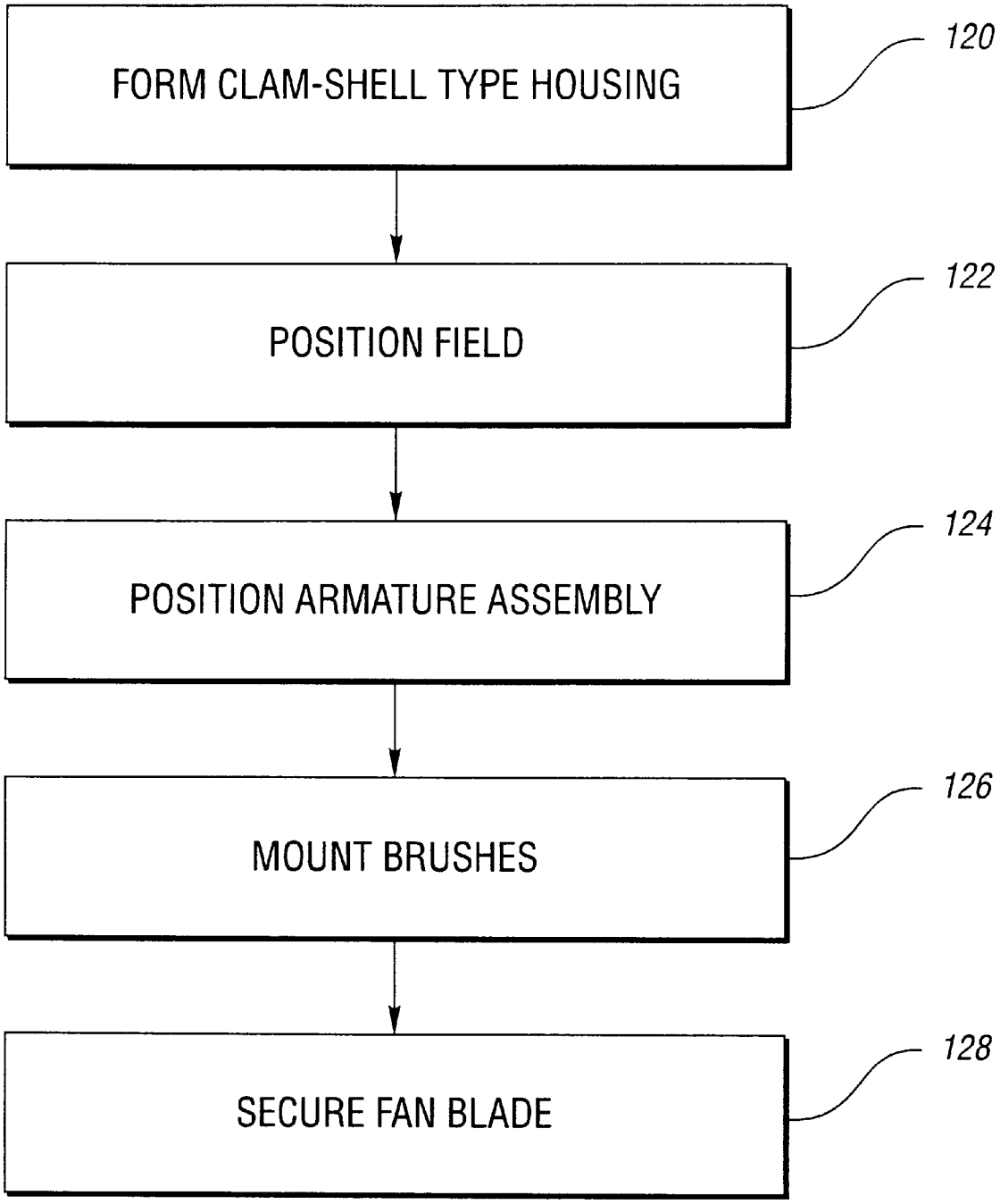
FIG. 5 is a block diagram illustrating a method of the present invention for assembling a vacuum cleaner motor assembly.

With reference to FIG. 5, a method of the present invention is illustrated. At block 120, a clam-shell type housing having a plurality of cooperating shell components is formed. At block 122, a field is positioned in the motor cavity. At block 124, an armature assembly is positioned in the housing. At block 126, a pair of brushes are mounted to the housing in the motor cavity. At block 128, a fan blade is secured to the armature shaft for rotation together therewith. Preferably, a power connector having a pair of slots for receiving a pair of leads is integrally formed with the housing. Further, the housing is preferably made of plastic.

Embodiments of the present invention provide a clam-shell type motor assembly for use in vacuum cleaners. It is to be appreciated that direct mounting of internal motor components in the shell components that form the clam-shell housing increases overall motor assembly costs. Further, it is to be appreciated that the planar part line of housing 20 (FIG. 2) and the nonplanar part line of housing 100 (FIG. 4) are purely illustrative in nature. Clam-shell type motor assemblies for vacuum cleaners may be formed with any number of shell components, with any desired part lines, in accordance with the present invention.

While the best modes for carrying out the invention have been described in detail, those familiar with the art to which this invention relates will recognize various alternative designs and embodiments for practicing the invention as defined by the following claims.

What is claimed is:

1. A motor assembly for use in an upright vacuum cleaner, the motor assembly comprising:

a clam-shell type housing having a pair of shell halves that cooperate with each other to define therebetween a fan cavity and a motor cavity adjacent to the fan cavity, the housing having an inlet in communication with the fan cavity and an outlet in communication with the fan cavity;

a field received in the motor cavity and securely clamped between the shell halves;

an armature assembly including an armature shaft extending through the field and extending into the fan cavity, and a commutator affixed generally adjacent to the armature shaft for rotation together therewith;

a pair of brushes mounted to the housing in the motor cavity and contacting the commutator; and a fan blade disposed in the fan cavity and secured to the armature shaft for rotation together therewith, the fan blade rotating with the armature shaft during motor operation to cause air flow from the fan cavity inlet to the fan cavity outlet.

2. The assembly of claim 1 further comprising:

a pair of brush holders receiving the pair of brushes.

3. The assembly of claim 1 wherein the housing defines a pair of bearing seats, and wherein the assembly further comprises:

a pair of bearings received on the pair of bearing seats and supporting the armature shaft.

4. A motor assembly for use in a vacuum cleaner, the motor assembly comprising:

a clam-shell type housing having a plurality of shell components that cooperate with each other to define a fan cavity and a motor cavity adjacent to the fan cavity, the housing having an inlet in communication with the fan cavity and an outlet in communication with the fan cavity;

a field received in the motor cavity;

an armature assembly including an armature shaft extending through the field and extending into the fan cavity, and a commutator affixed generally adjacent to the armature shaft for rotation together therewith;

a pair of brushes mounted to the housing in the motor cavity and contacting the commutator; and a fan blade disposed in the fan cavity and secured to the armature shaft for rotation together therewith, the fan blade rotating with the armature shaft during motor operation to cause air flow from the fan cavity inlet to the fan cavity outlet;

a pair of leads for connecting the motor to a power source; and a power connector having a pair of slots for receiving the pair of leads therein, the power connector being formed integrally with the housing.

5. The assembly of claim 1 wherein the housing is made of plastic.

6. An upright vacuum cleaner comprising:

a vacuum cleaner chassis having a head portion for moving along a surface being vacuumed and a body portion pivotally attached to the head portion;

a clam-shell type housing mounted to the body portion to pivot with the body portion relative to the head portion and having a pair of shell halves that cooperate with each other to define therebetween a fan cavity and a motor cavity adjacent to the fan cavity, the housing having an inlet in communication with the fan cavity and an outlet in communication with the fan cavity;

a field received in the motor cavity and securely clamped between the shell halves an armature assembly including an armature shaft extending through the field and extending into the fan cavity, and a commutator affixed generally adjacent to the armature shaft for rotation together therewith;

a pair of brushes mounted to the housing in the motor cavity and contacting the commutator; and a fan blade disposed in the fan cavity and secured to the armature shaft for rotation together therewith, the fan blade rotating with the armature shaft during motor operation to cause air flow from the fan cavity inlet to the fan cavity outlet.

7. The vacuum cleaner of claim 6 further comprising:

a pair of brush holders receiving the pair of brushes.

8. The vacuum cleaner of claim 6 wherein the housing defines a pair of bearing seats, and wherein the assembly further comprises:

a pair of bearings received on the pair of bearing seats and supporting the armature shaft.

9. The vacuum cleaner of claim 6 wherein the housing is formed by first and second mating shell halves, the first and second shell halves cooperating to hold the field, armature assembly, and brushes in position within the housing.

10. A vacuum cleaner comprising:

a vacuum cleaner chassis;

a clam-shell type housing mounted to the chassis and having a plurality of shell components that cooperate with each other to define a fan cavity and a motor cavity adjacent to the fan cavity, the housing having an inlet in communication with the fan cavity and an outlet in communication with the fan cavity;

a field received in the motor cavity;

an armature assembly including an armature shaft extending through the field and extending into the fan cavity, and a commutator affixed generally adjacent to the armature shaft for rotation together therewith;

a pair of brushes mounted to the housing in the motor cavity and contacting the commutator; and a fan blade disposed in the fan cavity and secured to the armature shaft for rotation together therewith, the fan blade rotating with the armature shaft during motor operation to cause air flow from the fan cavity inlet to the fan cavity outlet;

a pair of leads for connecting the motor to a power source; and a power connector having a pair of slots for receiving the pair of leads therein, the power connector being formed integrally with the housing.

11. The vacuum cleaner of claim 6 wherein the housing is made of plastic.

12. A method of assembling a motor assembly for a vacuum cleaner, the method comprising:

forming a clam-shell type housing having a plurality of shell components that cooperate with each other to define a fan cavity and a motor cavity adjacent to the fan cavity, the housing having an inlet in communication with the fan cavity and an outlet in communication with the fan cavity;

positioning a field in the motor cavity;

positioning an armature assembly in the housing, the armature assembly including an armature shaft extending through the field and extending into the fan cavity, and a commutator affixed generally adjacent to the armature shaft for rotation together therewith;

mounting a pair of brushes to the housing in the motor cavity, the brushes contacting the commutator;

securing a fan blade to the armature shaft for rotation together therewith, the fan blade being positioned in the fan cavity and rotating with the armature shaft during motor operation to cause air flow from the fan cavity inlet to the fan cavity outlet;

connecting a pair of leads to the motor for connecting the winding to a power source; and forming a power connector having a pair of slots for receiving the pair of leads therein, the power connector being formed integrally with the housing.

13. The method of claim 12 further comprising:

mounting a pair of brush holders to the housing, the brush holders receiving the brushes.

14. The method of claim 12 wherein the housing defines a pair of bearing seats, and wherein the method further comprises:

positioning a pair of bearings on the pair of bearing seats to support the armature shaft.

15. The method of claim 12 wherein forming further comprises:

forming the housing with first and second mating shell halves, the first and second shell halves cooperating to hold the field, armature assembly, and brushes in position within the housing.

16. The method of claim 12 wherein forming further comprises:

forming the housing as a plastic housing.

* * * * *